United States Patent [19]

Chin et al.

[11] Patent Number: 4,785,300

[45] Date of Patent: Nov. 15, 1988

[54] PRESSURE PULSE GENERATOR

[75] Inventors: Wilson C. Chin, Houston; José A. Treviño, Richmond, both of Tex.

[73] Assignee: Schlumberger Technology Corporation, New York, N.Y.

[21] Appl. No.: 924,171

[22] Filed: Oct. 28, 1986

Related U.S. Application Data

[63] Continuation of Ser. No. 805,391, Dec. 2, 1985, abandoned, which is a continuation of Ser. No. 545,313, Oct. 24, 1983, abandoned.

[51] Int. Cl.[4] ..... G01V 1/00

[52] U.S. Cl. ..... 340/861; 367/84; 137/499

[58] Field of Search ..... 367/81–85, 367/25, 911, 912; 181/102, 106; 340/861, 853; 33/306, 307; 73/151; 175/40, 50, 232; 137/499, 495, 624.13, 624.15, 624.18, 625.31, 499, 498; 251/133; 415/123, 501, 502; 138/45, 46, 37

[56] References Cited

U.S. PATENT DOCUMENTS

| | | | |
|---|---|---|---|
| Re. 29,734 | 8/1978 | Manning | 367/83 |
| Re. 30,055 | 7/1979 | Claycomb | 367/84 |
| 1,898,244 | 2/1933 | Dodrill | 137/499 |
| 2,904,067 | 9/1959 | Johansson | 137/499 |
| 3,309,656 | 3/1967 | Godbey | 367/85 |
| 3,705,603 | 12/1972 | Hawk | 340/853 X |
| 3,764,968 | 10/1973 | Anderson | 367/84 |
| 3,764,969 | 10/1973 | Cubberly, Jr. | 367/84 |
| 3,764,970 | 10/1973 | Manning | 367/84 |
| 3,770,006 | 11/1973 | Sexton et al. | 367/83 X |
| 3,792,429 | 2/1974 | Patton et al. | 367/84 |
| 3,867,714 | 2/1975 | Patton | 367/85 |

*Primary Examiner*—Deborah L. Kyle
*Assistant Examiner*—Brian S. Steinberger

[57] ABSTRACT

An improved acoustic signal generator has rotor and stator elements, each having a plurality of radially-extending lobes and intervening ports relatively positioned and configured to establish fluid dynamic forces that bias the generator into an open position, thereby imparting a "stable open" characteristic to the generator. The rotor is located downstream of the stator, and rotor lobes are outwardly tapered in the downstream direction and have underlap relative to the upstream stator lobes. The invention is especially suited for use in oil industry MWD operations to communicate downhole measurement data to a well surface during drilling. In one embodiment, undercuts on the rotor lobes impart a flutter action which clears debris.

13 Claims, 4 Drawing Sheets

FIG. 1
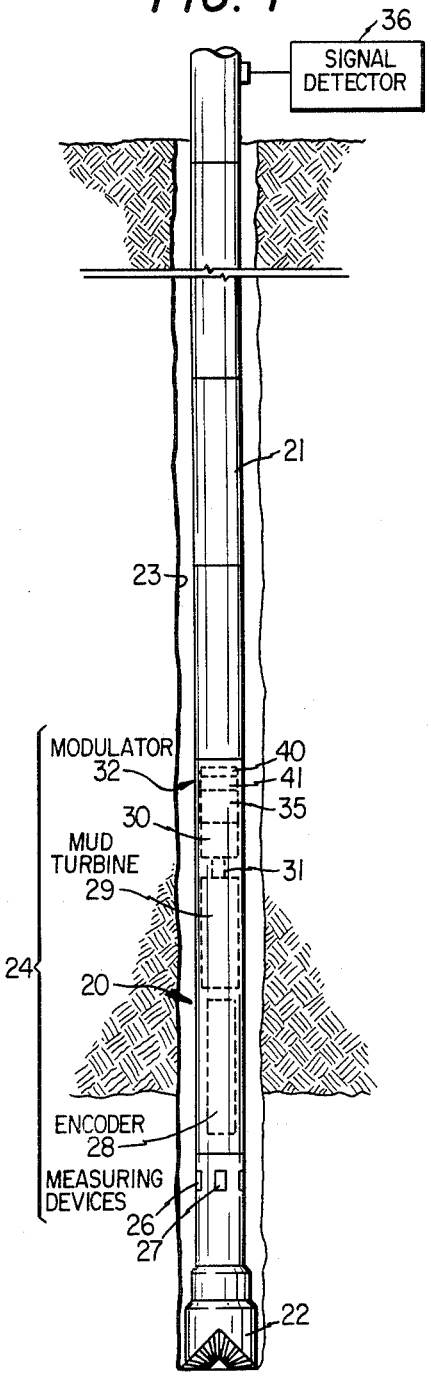
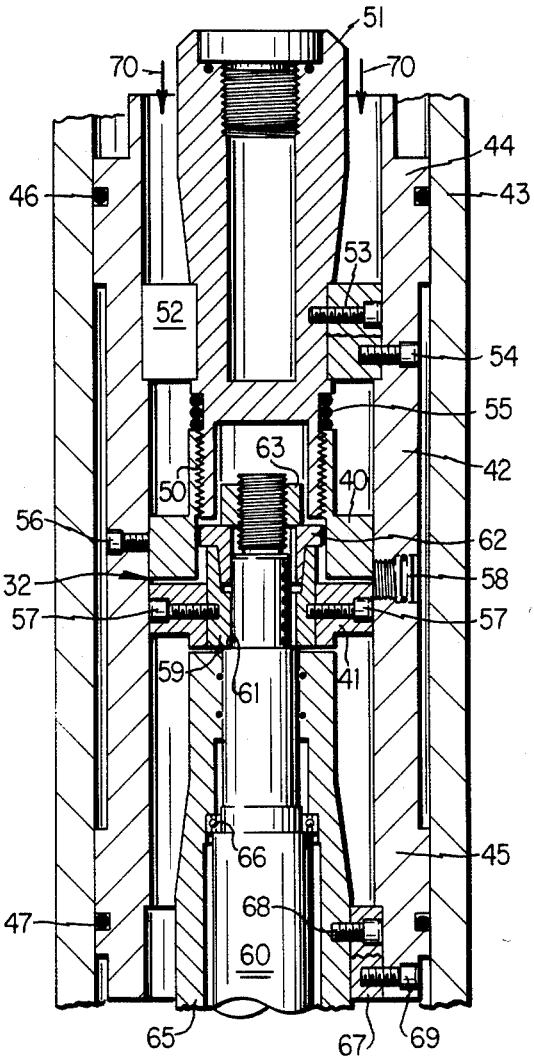
FIG. 2

FIG. 6
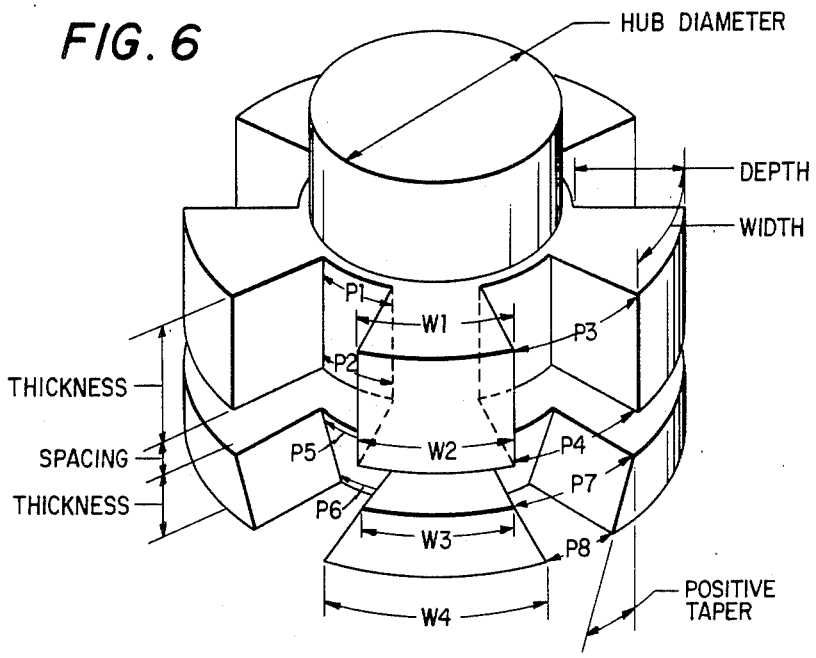
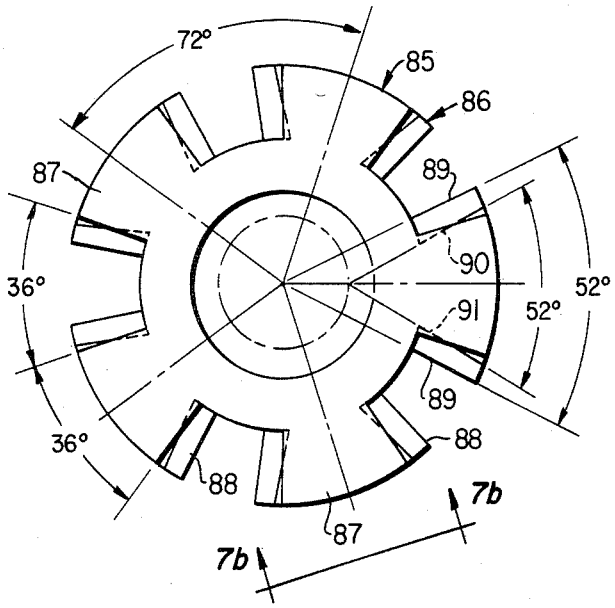
FIG. 7a
FIG. 7b
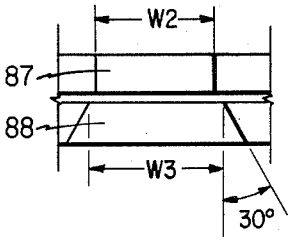

PRESSURE PULSE GENERATOR

This is a continuation of co-pending application Ser. No. 805,391 filed on Dec. 2, 1985, which is a continuation of application Ser. No. 545,313 filed on Oct. 24, 1983, both now abandoned.

BACKGROUND OF THE INVENTION

1. Field of the Invention

The present invention relates to pressure pulse generators in general, and in particular to pressure pulse generators such as the "mud siren" type used in oil industry MWD (measurements-while-drilling) operations to transmit downhole measurement information to the well surface during drilling by way of a mud column located in a drill string.

2. Description of the Prior Art

Many systems exist for transmitting data representative of one or more measured downhole conditions to the surface during the drilling of a well borehole. One such system, described in Godbey U.S. Pat. No. 3,309,656, employs a downhole pressure pulse generator or modulator and is operated to transmit modulated signals carrying encoded data at acoustic frequencies to the surface by way of the mud column in the drill string. In such a system, it has been found useful to power the downhole electrical components by means of a self-contained mud-driven turbine generator unit (known as a "mud turbine") positioned downstream of the modulator.

Existing modulators of the mud siren type usually take the form of "turbine-like" signal generating valves positioned in the drill string near the drill bit and exposed to the circulating mud path. A typical such modulator is comprised of a fixed stator and a motor-driven rotatable rotor, positioned coaxially of each other. The stator and rotor are each formed with a plurality of block-like radial extensions or lobes spaced circumferentially about a central hub so that the gaps between adjacent lobes present a plurality of openings or ports to the oncoming mud flow stream. When the respective ports of the stator and rotor are in direct alignment, they provide the greatest passageway for flow of drilling mud through the modulator. When the rotor rotates relative to the stator, alignment between the respective ports is shifted, interrupting the flow of mud to generate pressure pulses in the nature of acoustic signals. Rotation of the rotor relative to the stator in the circulating mud flow produces a cyclic acoustic signal that travels up the mud column in the drill string to be detected at the drillsite surface. By selectively varying the rotation of the rotor to produce changes in the signal, modulation in the form of an encoded pressure pulse is achieved which carries information from downhole instruments to the surface for analysis.

The lobe configuration and the relative placement of the stator and rotor elements of conventional modulators is such as to subject the rotor to fluid dynamic forces due to the mud stream that cause the rotor to seek a "stable closed" position in which the lobes of the rotor block the ports of the stator. There is thus an undesirable tendency for the modulator to assume a position that blocks the free flow of drilling mud whenever the rotor becomes even temporarily inoperative. This increases the likelihood that the modulator will jam, as solids carried by the mud stream are forced to pass through restricted modulator passages. Rotor restart is made more difficult because the reduced mud flow interferes with the generation of rotor power by the mud turbine below. Prolonged modulator closing can obstruct mud flow to such an extent that lubrication of the drill bit and other vital functions of the mud become so adversely affected, that the entire drilling operation is jeopardized.

A number of approaches have been proposed to solve the problem caused by the tendency of existing modulators to assume the closed position described above. One such approach, described in Patton, et al. U.S. Pat. No. 3,792,429, is to use magnetic force to bias the modulator toward an open position and hold it there in the event the rotor becomes inoperative. Magnetic attraction between a magnet attached to the modulator housing and a cooperating magnetic element positioned on the rotor shaft develops sufficient torque to overcome the fluid dynamic torque caused by the drilling mud stream. This approach has the disadvantages that the tool must be lengthened to accommodate the magnets and that introduction of an extraneous magnetic field downhole can interfere with measurements of the earth's magnetic field (used to derive tool orientation).

In commercial MWD operations, the spacing between the rotor and stator components of the modulator must be narrow in order to produce satisfactory acoustic signals. This requirement makes the modulator particularly susceptible to jamming or obstruction by solids present in the mud stream. A system for avoiding such jamming, described in Manning U.S. Pat. No. Re. 29,734, includes control means responsive to conditions tending to slow the motor (such as an increase in pressure differential across the modulator or an increase in driving torque requirement) for temporarily separating the rotor and stator in order to allow debris to be cleared from the modulator by the flowing mud. Such a system can be employed to provide some relief from the decreased mud flow experienced with a closed modulator by separating the modulator parts in response to the pressure differential increase experienced when the modulator assumes a closed position.

SUMMARY OF THE INVENTION

The present invention provides an improved pressure pulse generator or modulator of the type used for communicating information between points of a wellbore by way of fluid flowing in a tubing string which includes means responsive to the flow of fluid in the string for establishing fluid dynamic forces that bias the generator into a stable open position.

A pressure pulse generator structured in accordance with one aspect of the present invention comprises a fixed stator and a rotatable rotor both mounted within a housing adapted to be connected in a tubing string so that fluid flowing in the string will at least partially flow through the housing. The rotor is mounted adjacent to and downstream of the stator. Both stator and rotor are formed to have a plurality of radial extensions or lobes, with intervening gaps between adjacent lobes serving to present a plurality of ports or openings for the passage of fluid flowing through the housing. Rotation of the rotor relative to the stator will vary the blocking effect of the rotor extensions to flow issuing from the stator ports, shifting the relative alignment of the respective stator and rotor ports between a position providing the greatest passageway for fluid flow through the housing ("open" position) and a position providing the least passageway for fluid flow through the housing ("closed" position). This valve action interrupts fluid flow in such a manner as to cause the generation and transmission through the flowing fluid upstream of a pressure pulse signal. The relative placement of the stator and rotor and the specific configuration of their respective lobes are such that fluid dynamic forces are established in response to the flow of fluid in the housing that bias the rotor into an orientation providing the greatest fluid passageway through the generator. Should the generator fail or otherwise become inoperative, fluid forces will urge it into a position of minimum flow blockage.

In general, the forces are developed from the fluid flow by providing each lobe of the rotor with sides outwardly tapered in the downstream direction and with underlap relative to the stator lobes. The taper of each side on the rotor lobes is preferably in the range of about 8° to 30° with respect to a vertical axis.

In another aspect of the present invention, the rotor lobes are configured in such a manner as to cause the rotor to oscillate between an open position and a partially closed position due to fluid dynamic action. This serves to prevent debris from blocking the flow of fluid through the modulator and provides a periodic motion and signal whose frequency varies with flowrate. The oscillation takes the form of aerodynamic flutter created by providing the sides of each rotor lobe with reduced width, untapered regions at their trailing edges adjacent to the base of the lobe. The sides of the rotor lobes may also be provided with untapered regions at their leading edges adjacent to the top of the lobe so as to provide a cutting action upon debris passing into the ports and into the gap between the stator and rotor.

The modulator of the present invention provides an improved signal source having good obstruction avoidance capabilities. It has particular application in the oil industry in measurements-while-drilling, well testing and completed well monitoring operations as a signal source for communications from downhole to surface, from surface to downhole, or between intermediate points of a well. Other applications include its use as a sound source for underwater seismological explorations, use as a flow monitoring device and use as a unidirectional flow valve.

BRIEF DESCRIPTION OF THE DRAWINGS

The construction, operation, and advantages of the invention can be better understood by referring to the drawings forming a part of the specification, in which:

FIG. 1 is a schematic view of a pressure pulse generator in accordance with the present invention, shown coupled in a drill string of a typical drilling operation in its application for communication between a downhole MWD tool and a well surface;

FIG. 2 is a side view, in partial section, of the generator of FIG. 1;

FIG. 6 is a schematic perspective view identifying reference characters helpful in understanding relative dimensions;

FIG. 7*a* is a top plan view of a modified embodiment of the pressure pulse generator of FIGS. 1–5*c;*

FIG. 7*b* is an end view as seen from the line 7*b*—7*b* of one set of the stator and rotor lobes of FIG. 7*a;*

Throughout the drawings, like reference numerals are used to identify like parts.

DESCRIPTION OF THE PREFERRED EMBODIMENTS

Figure 3A:
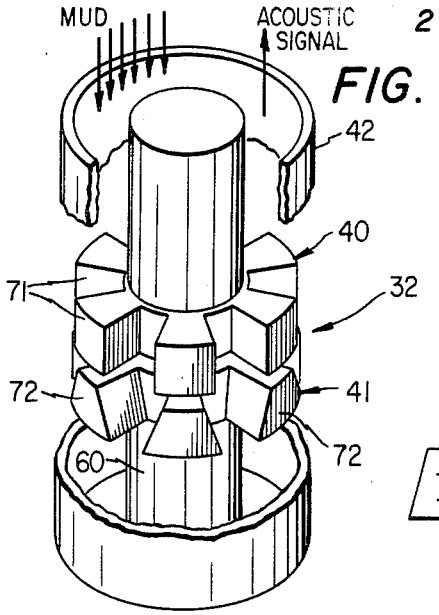
FIG. 3*a* is a perspective view of the generator of FIGS. 1 and 2.

FIG. 1 of the drawings shows a tubular measurements-while-drilling (MWD) tool 20 connected in a tubular drill string 21 having a rotary drill bit 22 coupled to the end thereof and arranged for drilling a borehole 23 of a well through various earth formations. As the drill string 21 is rotated by a conventional drilling rig (not shown) at the surface of the borehole 23, substantial volumes of a suitable drilling fluid (known as "drilling mud") are continuously pumped down through the drill string 21 and discharged from the drill bit 22 to cool the bit and to carry away earth cuttings removed by the bit. The mud is returned to the surface up along the annular space existing between the walls of the borehole 23 and the exterior of the drill string 21. The circulating mud stream flowing through the drill string 21 serves as a medium for transmitting pressure pulse signals carrying information from the MWD tool 20 to the surface, as described more fully below.

A downhole data signaling unit 24 has transducers mounted on the tool 20 that take the form of one or more condition responsive devices 26 and 27 coupled to appropriate data encoding electrical circuitry, such as an encoder 28, which sequentially produces encoded digital data electrical signals representative of the measurements obtained by the transducers 26 and 27. The transducers 26 and 27 are selected and adapted as required for the particular application to measure such downhole parameters as the downhole pressure, the temperature, and the resistivity or conductivity of the drilling mud or adjacent earth formations, as well as to measure various other downhole conditions similar to those obtained by present day wireline logging tools.

Electrical power for operation of the data signaling unit 24 is provided by a typical rotatably-driven axial flow mud turbine 29 which has an impeller 30 responsive to the flow of drilling mud that drives a shaft 31 to produce electrical energy.

The data signaling unit 24 also includes a modulator 32 which is driven by a motor 35 to selectively interrupt or obstruct the flow of the drilling mud through the drill string 21 in order to produce digitally-encoded pressure pulses in the form of acoustic signals. The modulator 32 is selectively operated in response to the data-encoded electrical output of the encoder 28 to generate a correspondingly encoded acoustic signal. This signal is transmitted to the well surface by way of the fluid flowing in the drill string 21 as a series of pressure pulse signals which preferably are encoded binary representations of measurement data indicative of the downhole drilling parameters and formation conditions sensed by the transducers 26 and 27. When these signals reach the surface, they are detected, decoded and converted into meaningful data by a suitable signal detector 36, such as shown in U.S. Pat. Nos. 3,309,656; 3,764,968; 3,764,969; and 3,764,970.

The modulator 32 includes a fixed stator 40 and a rotatable rotor 41 which is driven by the motor 35 in response to signals generated by the encoder 28. Rotation of the rotor 41 is controlled in response to the data-encoded electrical output of the encoder 28 in order to produce a correspondingly encoded acoustic output signal. This can be accomplished by applying well-known techniques to vary the direction or speed of the motor 35 or to controllably couple/uncouple the rotor 41 from the drive shaft of the motor 35.

The stator 40 has a plurality of evenly-spaced block-like lobes 71 circumferentially arranged about a central hub. The gaps between adjacent lobes 71 provide a plurality of ports to pass the incident drilling mud through the stator as jets or streams directed more or less parallel to the stator hub axis. The rotor 41 has a similar configuration to that of the stator 40 and is positioned adjacent to and downstream of the stator for rotation about an axis coaxial with the hub axis of the stator. As the rotor 41 is rotated, its lobes 72 successively move into and out of positions obstructing the flow of the fluid jets through the ports of the stator 40, to produce a pressure pulse signal that is transmitted upstream in the circulating mud.

When the rotor 41 is rotated in relation to the stator 40 so as to momentarily present the greatest flow obstruction to the circulating mud stream, the resulting acoustic signal will be at its maximum amplitude. As the rotor 41 continues to rotate, the amplitude of the acoustic signal produced by the modulator 32 will decrease from its maximum to its minimum value as the rotor moves to a position in which it presents the least obstruction to the mud flow. Further rotor rotation will cause a corresponding increase in signal amplitude as the rotor again approaches its next maximum flow obstruction position.

Those skilled in the art will recognize that rotation of the modulator rotor 41 will produce an acoustic output signal having a cyclic waveform with successively alternating positive and negative peaks referenced about a mean pressure level. Continuous rotation of the rotor 41 will produce a typical alternating or cyclic signal at a designated frequency which will have a determinable phase relationship in relation to some other alternating signal, such as a selected reference signal generated in the circuitry of the signal detector 36. By momentarily advancing, retarding, stopping or reversing the rotation of the rotor 41 in response to output from the encoder 28, the rotor can be selectively shifted to a different position vis-a-vis the stator 40 than it would have occupied had it continued to rotate without change. This selective shifting causes the phase of the acoustic signal to shift relative to the phase of the reference signal. Such controlled phase shifting of the signal generated by the modulator 32 acts to transmit downhole measurement information by way of the mud column to the well surface for detection by the signal detector 36. A shift in phase at a particular instance signifies a binary bit "1" (or "0") and absence of a shift signifies a binary bit "0" (or "1"). Other signal modulation techniques are usable, and selection of the specific encoding, modulation and decoding schemes to be employed in connection with the operation of the modulator 32 are matters of choice, detailed discussion of which is unnecessary to an understanding of the present invention.

As shown in FIG. 2, both the stator 40 and the rotor 41 are mounted within a tubular housing 42 which is force-fitted within a portion of a drill collar 43 by means of enlarged annular portions 44 and 45 of the housing 42 which contact the inner surface of the drill collar 43. A plurality of "O"-rings 46 and 47 provide sealing engagement between the collar 43 and the housing 42.

The stator 40 is mounted by way of threaded connections 50 (see also FIG. 4*b*) to an end of a supporting structure 51 centrally located within the housing 42 and locked in place by a set screw 56. The space between the end of the threaded portion of the stator 40 and an adjacent shoulder of the supporting structure 51 is filled with a plurality of "O"-rings 55. The supporting structure 51 is maintained in spaced relationship to the inner walls of the housing 42 by means of a front standoff or spider 52. The standoff 52 is secured to the supporting structure 51 by way of a plurality of hex bolts 53 (only one of which is shown) and, in turn, secured to the housing 42 by a plurality of hex bolts 54 (only one of which is shown). The front standoff 52 is provided with a plurality of spaced ports to permit the passage of drilling fluid in the annular space formed between the supporting structure 51 and the inner walls of the housing 42.

The rotor 41 is mounted for rotation on a shaft 60 of the motor 35 (FIG. 1) which drives the rotor 41. The rotor 41 has a rotor bushing 59 (FIG. 2) keyed near the end of the shaft 60 and forced into abutment with a shoulder 61 of the shaft 60 by a bushing 62 also keyed to the end of the shaft 60. The bushing 62 is forced against the rotor bushing 59 by means of a hex nut 63 threaded to the free end of the shaft 60. An inspection port 58 is provided for examining the stator and rotor lobes 71, 72 to measure rotor-stator spacing and to detect wear.

The shaft 60 is supported within a bearing housing 65 for rotation about a bearing structure 66. The bearing housing 65 is supported in spaced relationship to the inner walls of the housing 42 by way of rear standoff or spider 67 secured to the bearing housing by way of hex bolts 68 and, in turn, secured to the housing 42 by way of hex bolts 69.

As shown in FIGS. 2 and 3, drilling fluid flows into the top of the housing 42 in the direction indicated by arrows 70 (FIG. 2) through the annular space between the external wall of the supporting structure 51 and the inner walls of the housing 42 and flows through ports of the stator 40 and the rotor 41. The fluid flow continues past the rear standoff 67 and on to the drill bit 22 (FIG. 1). The shaft 60 drives the rotor 41 to interrupt the fluid jets passing through the ports of the stator 40 to generate a coded acoustic signal that travels upstream.

In accordance with the invention, the rotor 41 is positioned downstream of the stator 40 and its lobes 72 are configured to provide fluid dynamic forces in response to the mud flow which drive the rotor 41 to an open position relative to the stator 40 whenever the rotor 41 is not being driven by the motor 35. More specifically, the relative geometry and placement of the stator 40 and the rotor 41 establishes fluid dynamic biasing of the rotor 41 into an orientation in which the lobes 72 of the rotor 41 provide the least obstruction to fluid flowing through the ports of the stator 40.

FIGS. 3a–5c show thefeatures of a first embodiment of modulator 32 that exhibits such "stable open" behavior. FIG. 6 identifies dimensions useful in understanding these features.

The general relationship between the stator 40 and the rotor 41 of the modulator 32 is shown in FIG. 3a. As indicated by the arrows, drilling mud flows through the housing 42 in the downhole direction and rotation of the rotor 41 generates an acoustic signal that is transmitted uphole. In contrast to prior art modulators which usually position the rotor upstream of the stator, the rotor of the modulator 32 is located downstream of the stator.

As shown, both the stator 40 and the rotor 41 are provided with a plurality of radially extending lobes 71, 72 circumferentially spaced in a symmetrical fashion about coaxial central hubs. The lobes constitute wedge-like projections radiating from the hub, each lobe being defined by a top (upstream surface), a base (downstream surface), opposite radially-extending sides (surfaces extending outwardly from the hub that join the top and the base), and an end (surface furthest from and concentric with the hub that abuts the inner walls of the housing). All lobes 71 of the stator 40 are identically constructed and all lobes 72 of the rotor 41 are identically constructed. The same number of lobes is used for the stator and the rotor, this number being conveniently selected as six. Selection of a different number is possible, but will change the characteristics of the generated signal.

For more rigidity, either one or both of the stator 40 and rotor 41 may optionally be provided with a rim that circumscribes the ends of its lobes. The stator 40 may also, alternatively, be formed integrally with the housing 42. This is a choice based on manufacturing convenience.

The ports between adjacent lobes on each of the stator and the rotor are defined by the periphery of the hub and the facing sides of adjacent lobes. It is considered advantageous, though not essential, for the respective lobes and intervening ports to be dimensioned so that they are approximately the same size.

Figure 3B:
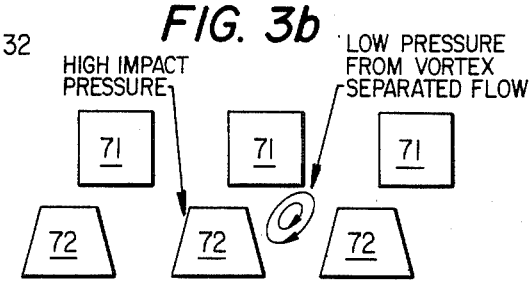
FIG. 3*b* is an unwrapped end view of the stator and rotor lobes of the generator of FIG. 3*a;*
Figure 4A:
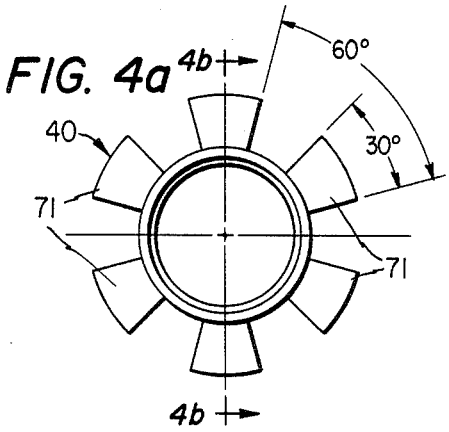
FIG. 4*a* is a top plan view of the stator of FIG. 3*a;*
Figure 4B:
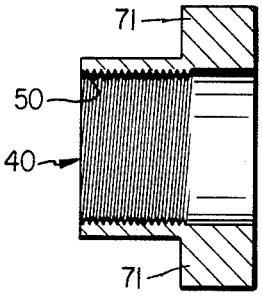
FIG. 4*b* is a section view taken along the line 4*b*—4*b* of FIG. 4*a;*

The six lobes 71 of the stator 40 (FIGS. 3a, 3b, 4a and 4b) are evenly distributed about the stator hub. The tops and bases of the stator lobes 71 are parallel to each other and perpendicular to the hub axis. The sides of the lobes 71 are generally radial with respect to the hub axis, with opposite sides of each lobe being angled at 30° and like sides of adjacent lobes being angled at 60° relative to the hub axis (FIG. 4a). The internal threads 50 provided on the inside of the stator hub (see FIG. 4b), in addition to connecting the stator 40 to the supporting structure 51 as described previously, provide means for adjusting the amplitude of the generated acoustic signal by varying the spacing between the bases of the stator lobes 71 and the tops of the rotor lobes 72. Stator lobes 71 are formed with the outer width W1 and area of the top of the lobe being equal to the outer width W2 and area of the base of the lobe (FIG. 6). Stator ports are formed to have equal inlet and outlet openings, with the inner and outer widths P1, P3 of the inlet openings being the same as the respective inner and outer widths P2, P4 of the outlet openings.

Figure 5C:
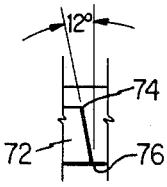
FIG. 5*c* is a partial end view as seen from the line 5*c*—5*c* of one of the lobes of the rotor of FIG. 5*a;*
Figure 5A:
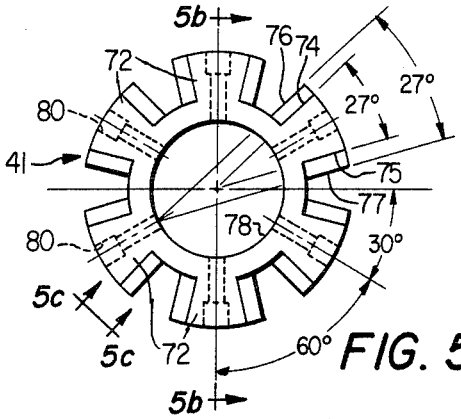
FIG. 5*a* is a top plan view of the rotor of FIG. 3*a;*

The rotor lobes 72 (FIGS. 3a, 3b and 5a–5c) are evenly distributed about the rotor hub so that radial lines drawn from the hub axis through centers of lobes 72 make angles of 60° with each other and angles of 30° with lines drawn from the hub axis through the centers of adjacent rotor ports (see FIG. 5a). Like those of the stator 40, the lobes 72 of the rotor 41 have parallel tops and bases which are perpendicular to the hub axis. The sides of the lobes 72, however, are outwardly tapered in the direction of fluid flow ("positive" taper). Thus, the outside width W4 (see FIG. 6) and area of the base (trailing face) of each rotor lobe 72 is greater than the corresponding outside width W3 and area of its top (leading face). FIG. 5c illustrates a preferred positive uniform taper of 12° for the sides of the lobes 72. Other tapers of 8° to 30° are also suitable.

As shown in FIG. 5a, the edges 74 and 75 of each rotor lobe 72 (formed where the sides meet the top) are angled at 27°, as are the edges 76 and 77 (formed where the sides meet the base). The tops of the rotor lobes 72 underlap the bases of the stator lobes 71, with the outside width W3 (FIG. 6) and area of the top of each rotor lobe 72 being less than the corresponding outside width W2 and area of the base of each stator lobe 71. The rotor ports are configured in a complementary way, so that the inside width P5, outside width P7 and area of the inlet opening of each rotor port are greater than the corresponding inside width P2, outside width P4 and area of the outlet opening of each stator port (see FIG. 6). Since the rotor ports are formed by the spaces between the rotor lobes 72, the sides of the ports are inwardly tapered in the downstream direction.

Figure 5B:
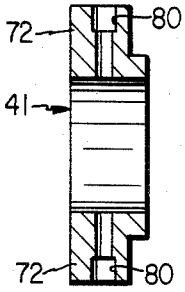
FIG. 5*b* is a section view taken along the line 5*b*—5*b* of FIG. 5*a;*

As shown in FIGS. 5a and 5b, each rotor lobe 72 has a bore 80 to receive the machine screws 57 (FIG. 2) which serve to fasten the lobes 72 to the rotor bushing 59.

The relative dimensioning of stator and rotor lobes 71, 72, as described, causes the flowing mud to exert fluid dynamic forces on the rotor which bias the modulator 32 into a stable open position. When the modulator 32 is in a nonequilibrium state as shown in FIG. 3b, forces are generated that act on the geometry of the modulator to cause high pressure to be applied to one side of the rotor lobes 72 and low pressure to be applied to the other side. These forces urge the rotor lobes 72 into positions directly below the stator lobes 71, thereby aligning stator and rotor ports to provide the greatest passageway for flow of fluid through the modulator 32.

Example stator and rotator dimensions for a modulator, configured as shown in FIGS. 3a–5c, that exhibits stable open performance are give below. Thses dimensions give an underlap between rotor and stator of $\frac{1}{8}$" and gave satisfactory performance at a rotor-stator spacing of 1/16". Dimensions are identified with reference to FIG. 6.

---

Stator 40

Number of Lobes = 6
Outside Diameter = $4\frac{1}{2}$"
Depth = $\frac{5}{8}$"
Width W1 = 15/16"
Width W2 = 15/16"
Thickness = 1"
Hub Diameter = $2\frac{1}{4}$"
Port Spacing P1 = $\frac{5}{8}$"
P2 = $\frac{5}{8}$"
P3 = 15/16"
P4 = 15/16"

Rotor 41

Number of Lobes = 6
Outside Diameter = 4 15/32"
Depth = 19/32"
Width W3 = 13/16"
Width W4 = $1\frac{1}{8}$"
Thickness = $\frac{5}{8}$"

-continued

| | |
|---|---|
| Hub Diameter = 2¼" | |
| Taper = 12° | |
| Port Spacing | P5 = ⅝" |
| | P6 = 3/8" |
| | P7 = 1" |
| | P8 = 11/16" |

It is pointed out that stable open performance is achieved only for the fluid flow direction shown in FIG. 3*a*. For fluid flow in the opposite direction, modulator 32 will exhibit the stable closed performance of prior art devices. For a freely rotatable shaft 60 (not driven and not prevented from rotating), modulator 32 will thus act in the manner of a check valve, opening in response to fluid flow in one direction and closing in response to fluid flow in the other direction.

Other embodiments of stable open modulators 32 can be constructed following the same principles applied above.

In general, the stator should be located upstream of the rotor. Stator lobes should preferably have straight (untapered) radially-extending sides and be dimensioned so that lobes and intervening ports have approximately the same size. The rotor thickness (FIG. 6) should prefrably be equal to or less than the thickness of the stator. The sides of the rotor lobes should be outwardly tapered in the downstream direction, with a positive taper preferably of 8° to 30°. Underlap should be provided between the top of the rotor lobes and the base of the stator lobes (i.e. the area of the top of the rotor lobes should be smaller than the area of the base of the stator lobes). The amount of underlap needed will depend on the rotor thickness and taper. The thinner the rotor, the less underlap will be required. Rotor-stator spacing should not be too small. Suitable spacing can be determined empirically. Smaller spacings give stronger signals; larger spacings give better stable open performance.

A second embodiment of the modulator 32, constructed in accordance with the foregoing criteria, comprises a stator 85 and a rotor 86 as illustrated in FIGS. 7*a* and 7*b*. The stator 85 has five lobes 87 evenly spaced about the periphery of a central stator hub. Example stastor and rotor dimensions for a stable open modulator, configured as shown in FIGS. 7*a* and 7*b* for operation with a rotor-stator spacing of 3/32", are given below:

| | |
|---|---|
| Stator 85 | |
| Number of Lobes = 5 | |
| Outside Diameter = 4⅜" | |
| Depth = ¾" | |
| Width W1 = 1 13/32" | |
| Width W2 = 1 13/32" | |
| Thickness = 1¼" | |
| Hub Diameter = 2 13/16" | |
| Port Spacing | P1 = 13/16" |
| | P2 = 13/16" |
| | P3 = 1 9/32" |
| | P4 = 1 9/32" |
| Rotor 86 | |
| Number of Lobes = 5 | |
| Outside Diameter = 4 11/32" | |
| Depth = ¾" | |
| Width W3 = 1 15/32" | |
| Width W4 = 1⅞" | |
| Thickness = 13/32" | |
| Hub Diameter = 2 13/16" | |
| Taper = 30° | |
| Port Spacing | P5 = 15/16" |
| | P6 = 17/32" |
| | P7 = 1 3/16" |
| | P8 = ¾" |

Radial lines drawn through the centers of adjacent lobes 87 make angles of 72° with each other. The opposite sides of each lobe 87 are angled at 36° and the facing sides of adjacent lobes 87 are also angled at 36°. The stator is thus symmetrical, with the size of its lobes being the same as the size of its ports.

The rotor 86 is located downstream of the stator 85 and likewise has five lobes 88 evenly spaced about a central hub. The sides of the lobes 88 are outwardly tapered in the downstream direction with a positive taper of 30°. The outside width W3 of each rotor top is slightly greater than the outside width W2 of each stator lobe base (see end view FIG. 7*b*). Underlap is provided between the stator lobes 87 and the rotor lobes 88 by providing a greater angle of convergence for the top edges of the sides of the rotor lobes 88 than for the bottom edges of the sides of the stator lobes 87. As shown in FIG. 7*a*, the lower edges 89 of the sides of each rotor lobe 85 are angled at 52° and radiate outwardly from a point on the center axis of the rotor hub. The upper edges 90 and 91 of the sides of each rotor lobe 86, also angled at 52°, radiate from a point along the lobe centerline displaced from the hub axis. Consequently, the rotor lobe top has a smaller surface area than that of the base of the stator lobe 85. Although the underlap at the adjacent edges of the ends of the rotor and stator lobes is slightly negative (W2−W3=−1/16" in the example given above), the underlap increases rapidly with lobe depth toward the hub.

Figure 8:
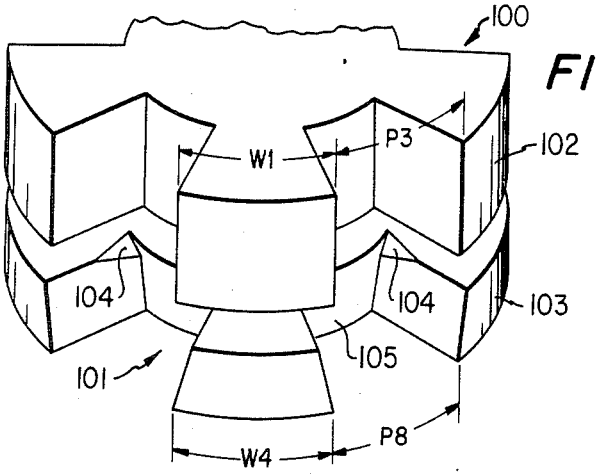
FIG. 8 is a fragmented perspective view of a further modification of the generator of FIGS. 1–5*c*, in which the rotor has a reduced portion adjacent the rotor hub.

FIG. 8 illustrates another embodiment of the present invention that comprises a stator 100 positioned upstream of a rotor 101. The stator 100 has six lobes and is similar to the stator 40, previously described with reference to FIGS. 4*a* and 4*b*. The sizes of the stator lobes 102 and intervening stator ports are the same, with the widths W1, W2, P3 and P4 all being equal (see FIG. 6). The rotor 101 is designed so that the outside width W4 of the base of each lobe 103 is equal to the outside width P8 of the outlet of each port. The relationship between stator 100 and rotor 101 dimensions is such that W1=W2=W4=P3=P4=P8. This configuration, wherein stator port inlet and outlet openings and rotor port outlet openings have the same sizes, minimizes interference of the rotor taper with the fluid flow when the modulator is in its open position. This has the advantage of reduced wear and erosion of the rotor lobes 103.

To improve the acoustic signal, rotor thickness can be reduced by milling the top of the rotor. This, however, reduces the underlap between the tops of the rotor lobes 103 and the bases of the stator lobes 102. To assure stable open performance, a region 104 of increased taper is provided by cuts made on an inside part (adjacent the rotor hub 105) of the upstream edges of the sides of the lobes 103. These partial cuts 104 assist the tapered sides to establish the fluid dynamic forces that provide the stable open characteristic of the modulator 32.

Figure 9:
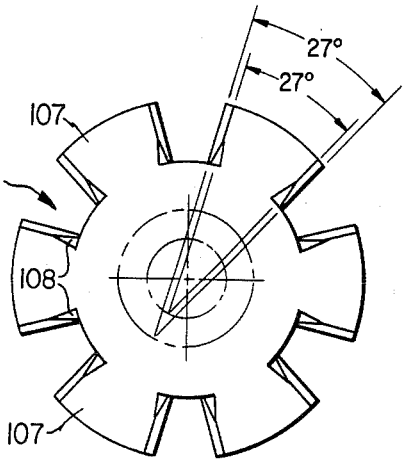
FIG. 9 is a top plan view of the rotor of FIG. 8.

FIG. 9 shows a modification of the partial cut construction of the rotor 101 of FIG. 8. The rotor 106 of FIG. 9 differs from the rotor 101 of FIG. 8 in that the outside widths W2, W4 and P4, P8 are not equal. The sides of each rotor lobe 107 each have a positive taper of approximately 12° and each lobe 107 is provided with partial cuts 108 of increased taper similar to the cuts 104 of rotor 101.

Figure 10A:
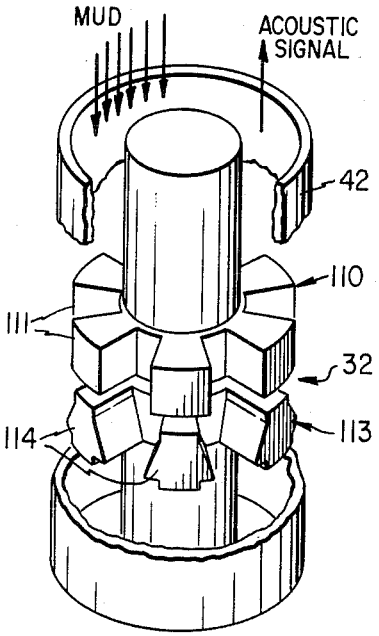
FIG. 10*a* is a perspective view of a yet further modification of the generator of FIGS. 1–5*c*, illustrating a design which gives rise to aerodynamic flutter.
Figure 10B:
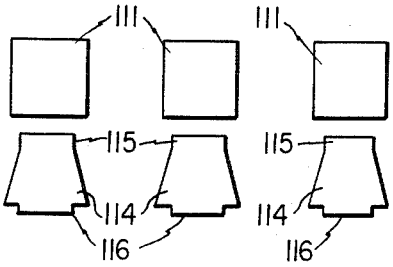
FIG. 10*b* is an unwrapped end view of the stator and rotor lobes of FIG. 10*a*.

Further modifications to the foregoing embodiments can be made to provide a modulator that not only exhibits the desirable stable open characteristic, but will also exhibit a fluid flow induced agitation to dislodge debris caught between the rotor and the stator. Such a modification is illustrated in FIGS. 10*a* and 10*b* in which a modulator 32 comprises a stator 110 and a rotor 113 mounted within a housing 42. The stator 110 is like the six-lobed stator 40 previously described. The sides of its lobes 111 are untapered and are generally radial with respect to the stator hub axis. The sides of the lobes 111 of the rotor 113, however, although including a central outwardly tapered region similar to that of previously described embodiments, also have leading and trailing untapered regions 115, 116 which are parallel to the sides of the stator lobes 111 (see unwrapped view of FIG. 10*b*.) The outer width W3 (FIG. 6) of the top of the rotor lobe 114 that abuts the leading untapered region 115 is less than the outer width W2 of the base of the stator lobe 111, thus providing underlap. The outer width W4 of the base of the rotor lobe 114 that abuts the trailing untapered region 116 is approximately the same as the outer width W3 of the top. The trailing untapered region 116 of each rotor lobe side is formed by undercutting the tapered region across the full depth of the rotor lobe 114. The edges between the rotor lobe top and the leading regions 115 of the rotor lobe sides are preferably sharp in order to assert a cutting action on debris lodged in the gap between the stator and the rotor.

The configuration of FIGS. 10*a* and 10*b* generates fluid dynamic forces in response to the drilling fluid through direct impact and vortex separation that act on the rotor 113 to urge the modulator into a stable open position. However, the restoring forces in the azimuthal direction are proportional to the angular displacement, with the result that a periodic motion in the nature of aerodynamic flutter is set up when the rotor is not driven by the shaft. The amplitude and frequency of the flutter depend on the fluid flow rate, the modulator configuration and the shaft inertia. This flutter causes the rotor lobes 114 to oscillate between partially closed and fully open positions, also generating an acoustic signal whose frequency depends upon the flutter rate. Since flutter rate is a function of flow rate, the modulator construction of FIGS. 10*a* and 10*b* can be employed for flow rate monitoring, with the frequency of the generated signal being monitored in a known way, such as by conventional frequency analyzing circuitry incorporated into the signal detector 36 (FIG. 1).

While particular embodiments of the present invention have been shown and described by way of example, it will be apparent to those skilled in the art to which the invention relates that further changes and modifications may be made without departing from the invention and its broader aspects and, therefore, the aim in the appended claims is to cover all such changes and modifications as fall within the spirit and scope of this invention.

What is claimed is:

1. A pressure pulse generator of the type used for communicating information between points of a wellbore by way of fluid flowing ina tubing string, comprising:

a housing having a fluid passageway therethrough adapted to be connected in the string so that fluid flowing in the string will at least partially flow through said passageway in the housing;

a stator fixedly mounted within the housing;

a rotor rotatably mounted within the housing adjacent to the stator; the stator and rotor each having a plurality of spaced lobes with gaps formed therebetween that present a plurality of ports for fluid passage such that rotation of the rotor relative to the stator will shift alignment of the respective stator and rotor ports from a position providing the greatest fluid passage to a position providing the least fluid passage to cause the generation and transmission upstream of a pressure pulse signal, the rotor being positioned downstream of the stator and said lobes having means for establishing fluid dynamic forces in response to the flow of fluid through the housing that bias the rotor generally into an orientation in which the ports provide the greatest fluid passage and wherein each of the stator and rotor lobes have upstream surface tops and downstream surface bases and respective pairs of oppositely facing sides extending between the tops and bases, and wherein the side to side width of the rotor lobes increases in the downstream direction and the area of the tops of the rotor lobes is smaller than the area of the bases of the stator lobes.

2. Apparatus as in claim 1 wherein the rotor lobe sides are tapered at an angle of 8° to 30°.

3. Apparatus as in claim 1 wherein the rotor sides include regions of increased taper at the edges formed by the abutment of the sides with the taps.

4. The apparatus of claim 1 further comprising: a condition responsive device adapted to be mounted in said string for measuring a downhole drilling parameter;

data encoding circuitry adapted to be mounted in said string and coupled to said at least one condition responsive device for sequentially producing encoded digital data electrical signals representative of the measured parameter;

means for selectively rotating the rotor in response to the data-encdded electrical signal output fo the data encoding circuitry to generate a correspondingly encoded pressure pulse signal for transmission upstream to the well surface in the column of fluid flowing in the string; and a signal detector located at the well surface and connected to the string for detecting the signal transmitted upstream from the generator, decoding it and converting it to meaningful data.

5. Apparatus as in claim 1, wherein the number of stator lobes is the same as the number of rotor lobes.

6. Apparatus as in claim 5, wherein the sizes of the stator and rotor lobes are generally the same as the sizes of the respective stator and rotor ports.

7. Apparatus as in claim 6, wherein the outer widths of the tops of the rotor lobes are less than the outer widths of the bases of the stator lobes.

8. Apparatus as in claim 6, wherein the outer widths of the tops of the rotor lobes are the same as the outer widths of the bases of the stator lobe, and wherein edges of the rotor lobes formed by the abutment of the sides with the tops of the rotor lobes converge at a greater angle of convergence than edges of the stator lobes formed by the abutment of the sides with the bases of the stator lobes.

9. Apparatus as in claim 1, wherein said stator and rotor include means for establishing fluid dynamic forces in response to the flow of fluid through the housing that causing the rotor to oscillate with a motion in the nature of aerodynamic flutter when the rotor is biased into the orientation in which the ports provide the greatest fluid passgeway.

10. Apparatus as in claim 9, wherein the rotor lobe sides have untapered regions at the edges formed by the abutment of the sides with the bases.

11. Apparatus as in claim 10, wherein the rotor lobe sides have untapered regions at the edges formed by the abutment of the sides with the tops.

12. A generator for producing an acoustic signal having characteristics dependent on the rate of fluid flow in a conduit, comprising:

a housing having a fluid passageway therethrough adapted to be positioned in the conduit so that fluid flowing in the conduit will at least partially flow through said passageway in the housing;

a stator fixedly mounted within the housing;

a rotor rotatably mounted within the housing adjacent to the stator; the stator and rotor each having a plurality of spaced lobes having tops, bases and oppositely facing sides extending between said tops and bases, the areas of the tops of the rotor lobes being smaller than the aress of the bottoms of the stator lobes, saids lobes having gaps formed therebetween that present a plurality of ports for fluid passage such that rotation of the rotor relative to the stator will shift alignment of the relative stator and rotor ports to cause the generation and transmission of an acoustic signal, the rotor being positioned downstream of the stator, the rotor lobe sides being outwardly tapered in the downstream direction and having means for establishing fluid dynamic forces in response to the flow of fluid through the housing to cause the rotor to oscillate between an open and a partially closed position with a motion in the nature of aerodynamic flutter so as to generate an acoustic signal that has characteristics that vary as a function of the rate of flutter.

13. A unidirectional flow valve permitting free fluid flow through a conduit in one direction and obstructing fluid flow through the conduit in the other direction, comprising:

a housing having a fluid passageway therethrough adapted to be connected in the conduit so that fluid flowing in the conduit will flow through said passageway in the housing;

a stator fixedly mounted within the housing;

a rotor rotatably mounted within the housing adjacent to the stator; the stator and rotor each having a plurality of ports for fluid passage such that rotation of the rotor relative to the stator will shift alignment of the respective stator and rotor ports from a position providing the greatest fluid passage to a position providing the least fluid passage, the rotor having means for repoducing fluid dynamic forces in response to the flow of fluid in one direction through the housing that move the rotor generally into an orientation in which the ports provide the greatest fluid passage and for establishing fluid dynamic forces in response to the flow of fluid in the opposite direction through the housing that move the rotor generally into an orientation in which the ports provide the least fluid pasasge and wherein each of the stator and rotor lobes have upstream surface tops and downstream surface bases and respective pairs of oppositely facing sides extending between the tops and bases, and wherein the side to side width of the rotor lobes increases in the downstream direction and the area of the tops of the rotor lobes is smaller than the area of the bases of the stator lobes.

* * * * *